US005137183A

United States Patent [19]

Mikulec et al.

[11] Patent Number: 5,137,183

[45] Date of Patent: Aug. 11, 1992

[54] COMPRESSIBLE FEEDING APPARATUS

[76] Inventors: Timothy L. Mikulec, 4802 Waxwing, Arlington, Tex. 76018; Michael Williams, 816 Fondren Dr., Arlington, Tex. 76017; Gail B. Frankel, 5710 Glen Heather Dr., Dallas, Tex. 75252

[21] Appl. No.: 562,584

[22] Filed: Aug. 2, 1990

[51] Int. Cl.[5] ..... B67D 5/00; B65D 37/00

[52] U.S. Cl. ..... 222/192; 222/212; 222/525

[58] Field of Search ..... 222/192, 212, 215, 525

[56] References Cited

U.S. PATENT DOCUMENTS

| | | | |
|---|---|---|---|
| 2,738,107 | 3/1956 | Graham | 222/212 |
| 3,120,910 | 2/1964 | Nyden | 222/525 |
| 3,390,821 | 7/1968 | Mullan | 222/215 |
| 3,395,835 | 8/1968 | Tarran | 222/192 |
| 3,833,154 | 9/1974 | Markowitz | 222/212 |
| 4,187,960 | 2/1980 | Bonk | 222/212 X |
| 4,813,577 | 3/1989 | Carow | 222/212 X |
| 4,830,222 | 5/1989 | Read | 222/192 X |

FOREIGN PATENT DOCUMENTS

| | | | |
|---|---|---|---|
| 1525105 | 5/1968 | France | 222/525 |

*Primary Examiner*—Michael S. Huppert
*Assistant Examiner*—Anthoula Pomrening
*Attorney, Agent, or Firm*—Konneker & Bush

[57] ABSTRACT

A compressible feeding apparatus for dispensing liquids, semi-solid foodstuffs or other edible or medicinal materials for feeding or administering to an infant, invalid or other person requiring assistance in such matters. The compressible feeding apparatus includes a feeding apparatus which includes a compressible receptacle, a nozzle assembly removably mounted on the receptacle and a utensil assembly slideably mounted on the nozzle assembly. The nozzle assembly includes as interior channel in communication with the interior of the receptacle and the utensil assembly includes an interior passage in communication with the interior channel. The sidewalls of the interior passage of the utensil assembly are configured to form, in combination with the nozzle assembly, a closeable valve for the feeder apparatus.

10 Claims, 2 Drawing Sheets

COMPRESSIBLE FEEDING APPARATUS

BACKGROUND OF THE INVENTION

1. Field of the Invention

This invention relates generally to feeding apparatuses and, more particularly, to a compressible feeding apparatus for dispensing foodstuffs onto an attached spoon assembly.

2. Description of Related Art

Various types of feeders and other devices for dispensing food, liquids or medicine, typically for use in connection with the feeding of an infant, are known. Most commonly, prior feeders include an open-ended receptacle for holding the foodstuff or other material to be dispensed. The stored material would then be dispensed through the open-end of the receptacle onto an attached utensil such as a spoon-shaped utensil where the dispensed material may be fed or otherwise administered to the intended recipient of the stored material. For example, U.S. Pat. No. 1,642,425 to Miller discloses a dispensing receptacle which utilizes gravity to dispense sugar from the container onto an attached spoon. To fill the attached spoon with sugar, the receptacle is tilted so that the sugar flows out of an opening in the top of the container. A second dispenser which also relies upon gravity for dispensing the stored material, in this case for the feeding of an infant, may be seen in U.S. Pat. No. 2,550,210 to Vance.

Other dispensers utilize compression for forcing food stored in the receptacle onto the spoon or other utensil for feeding. For example, U.S. Pat. No. 2,698,996 to Hickerson uses a plunger for forcing food or medicine out of an opening in the receptacle and onto an attached spoon-like utensil. Other feeding apparatus, while also using compression of the receptacle to deliver food to an attached spoon-like utensil, may be generally classified as using "squeeze-bottle" type compressible receptacles for delivering food to the attached utensil. For example, U.S. Pat. Nos. 2,252,119 to Edmonds, 2,837,822 to Wille, 2,953,170 to Bush, 3,116,152 to Smith and 4,888,188 to Castner, et al. all disclose feeding devices in which the receptacle is compressible along its longitudinal axis, for example, by squeezing the sidewalls of the compressible receptacle, to reduce the volume of the receptacle, thereby forcing foodstuffs or other material stored in the receptacle onto an attached spoon-like holding utensil.

Finally, a number of compressible dispensers incorporate the use of axially compressible receptacles for the delivery of materials stored within. For example, U.S. Pat. No. 4,044,836 to Martin et al. discloses a dispenser for dry powders, such as those used for extinguishing fires, in which a bellows-like central section of the receptacle is axially compressible to pump the dry powder out of the container. Similarly, U.S. Pat. No. 3,506,163 to Rauh discloses an article for holding and dispensing flowable materials such as liquids or semi-solids which includes a collapsible container which can be collapsed from an initial expanded position where it is filled with a flowable material towards a collapsed position where the volume of the container means is only a fraction of its initial volume.

It is an object of this invention to provide a compressible feeding apparatus which dispenses liquids, semi-solid foodstuffs, or other edible or medicinal materials by axially compressing the storage receptacle, thereby forcing material stored therein onto an attached utensil assembly.

It is another object of this invention to provide a compressible feeding apparatus which dispenses materials stored in an open-ended, axially compressible receptacle through an attached nozzle assembly which covers the open end of the receptacle and onto an attached utensil assembly upon axial compression of the receptacle, thereby permitting ready feeding or administering of the stored material.

It is yet another object of this invention to provide a compressible feeding apparatus which dispenses materials stored in an open-ended compressible receptacle through a nozzle assembly which covers an open end of the receptacle and onto an attached utensil assembly in which the utensil assembly is matable with the nozzle assembly, thereby providing ready opening and closing of the feeding apparatus.

SUMMARY OF THE INVENTION

In one aspect, the present invention comprises a feeding apparatus which includes a compressible receptacle, a nozzle assembly removably mounted on the receptacle and a utensil assembly slideably mounted on the nozzle assembly. The nozzle assembly includes an interior channel in communication with the interior of the receptacle and the utensil assembly includes an interior passage in communication with the interior channel. The sidewalls of the interior passage of the utensil assembly are configured to form, in combination with the nozzle assembly, a closeable valve for the feeder apparatus.

In another aspect, the present invention comprises a compressible feeding apparatus which includes a compressible receptacle having an interior opening for storing liquid, semi-solid foodstuffs, or other edible or medicinal materials therein and an open end, a nozzle assembly removably mounted on the receptacle and having an interior channel in communication with the interior of the receptacle for passage of the material stored therein, and a utensil assembly mounted on the nozzle assembly and displaceable between first and second positions. The utensil assembly also includes an interior passage for communicating with the interior channel of the nozzle assembly. In the first position, the interior channel and interior passage are in communication with each other and, in the second position, the interior channel is blocked from communication with the interior passage.

In yet another aspect, the present invention comprises a compressible feeding apparatus which includes a compressible receptacle having an interior opening for storing liquids semi-solid foodstuffs or other edible or medicinal materials therein and an open end in communication with the interior opening. A nozzle assembly which terminates in a frusto-conical nozzle end is removably mounted on the receptacle to cover the open end. The nozzle assembly includes an interior channel for passage of the material from the compressible receptacle therethrough. The nozzle end is provided with an annular aperture on the conical section side thereof. The annular aperture communicates with the interior channel of the nozzle assembly for the passage of the material therefrom. A utensil assembly displaceable between first and second positions is slideably mounted on the nozzle assembly. The utensil assembly is provided with interior sidewalls shaped to define a passage having a first, narrower section from which the materials are dispensed, and a second, wider section which slideably engages the nozzle assembly. The wider section of the interior passage includes one portion which is frusto-conical shape complementary with the conical section of the frusto-conical nozzle end. The interior sidewalls which define the frusto-conically shaped section of the interior passage are configured to slideably engage the conical section of the frusto-conical nozzle end. In the first position, the interior channel and interior passage are in communication with each other, thereby permitting the stored material to be dispensed. In the second position the interior channel is blocked from communication with the interior passage.

In one embodiment of this aspect of the invention, the interior sidewalls which define the frust-conically shaped section of the interior passage block the annular aperture and the tip of the nozzle assembly blocks the narrower section of the interior passage when the feeder is in the second, closed position. In another embodiment of this aspect of the invention, the nozzle section further includes a circumferential rib for limiting the travel of the slideably mounted utensil assembly and the interior sidewall of the utensil assembly is provided with an inner circumferential rib for engaging the circumferential rib of the nozzle section.

BRIEF DESCRIPTION OF THE DRAWING

The present invention may be better understood, and its numerous objects, features and advantages will become apparent to those skilled in the art by reference to the accompanying drawings in which.

DETAILED DESCRIPTION OF THE INVENTION

Figure 1:
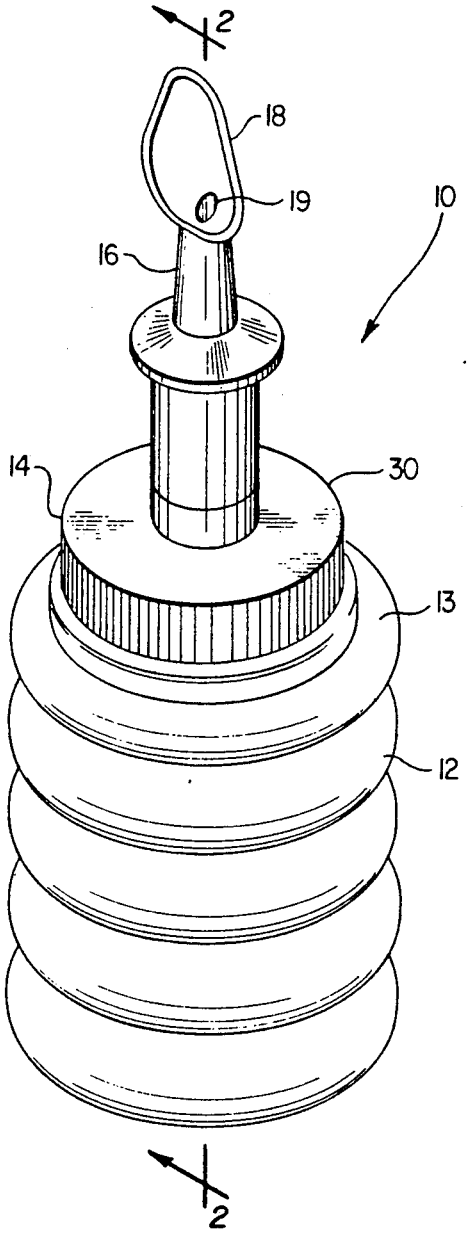
FIG. 1 is a perspective view of a compressible feeding apparatus constructed in accordance with the teachings of the present invention.

Referring first to FIG. 1, a compressible feeding apparatus 10 constructed in accordance with the teachings of the present invention may now be seen. The compressible feeding apparatus 10 is comprised of a compressible receptacle 12 which stores the foodstuffs to be dispensed, a nozzle assembly 14, which is threadably mounted on the compressible receptacle 12 in a manner to be more fully described below, and a utensil assembly 16 which is slideably mounted to the nozzle assembly 14 and displaceable between first and second positions. To dispense food from the compressible feeding apparatus 10, a user would, after opening it in a manner to be more fully described below, grasp the compressible feeding apparatus 10 in his or her hand, placing the thumb against a bottom wall 20 (visible in FIG. 2) of the receptacle 12, and place the middle and forefinger on either the top surface 13 of the compressible receptacle 12 or on a lid portion 30 of the nozzle assembly 14. By compressing the compressible receptacle 12 between these fingers, the liquid, semi-solid foodstuffs or other edible or medicinal material stored therein will be forced through the open end 11 (visible in FIG. 2) of the compressible receptacle 12, would flow through an interior channel 44 (again, visible in FIG. 2) in the nozzle assembly 14 and an interior passage 56 in the utensil assembly 16 and be dispensed onto a utensil section 18 of the utensil assembly 16. In the embodiment disclosed herein, the utensil section 18 of the utensil assembly 16 is illustrated as a generally spoon-shaped utensil. It is fully contemplated, however, that, in alternate embodiments of the invention, the utensil section 18 may be configured in the shape of other well known utensils such as knives, forks or other shapes consistent with the particular use contemplated for the compressible feeding apparatus as well as the particular consistency of the material being dispensed. Once the utensil section 18 is filled with the dispensed material, the material may then be fed or otherwise administered to an infant, invalid or other person requiring assistance in such matters.

Figure 2:
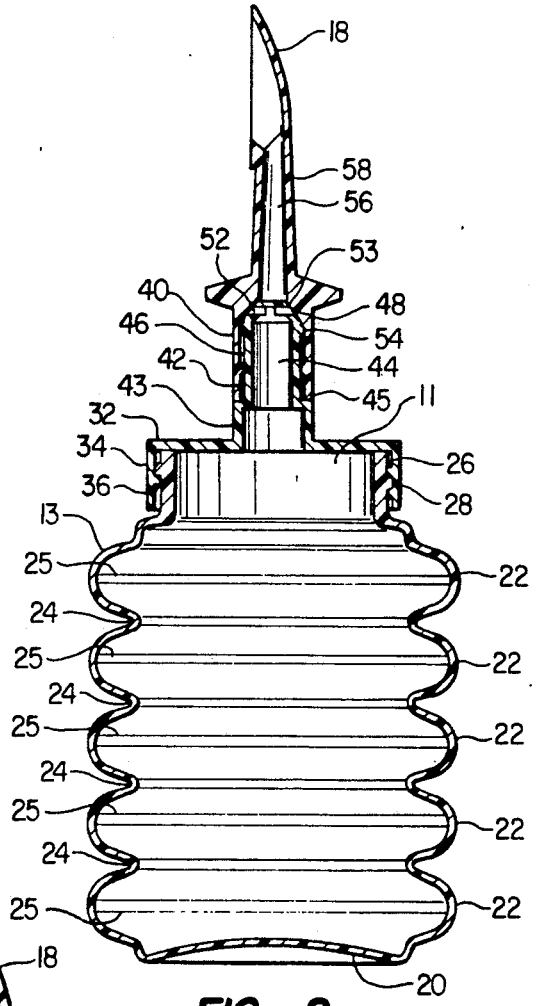
FIG. 2 is a cross-sectional view along lines 2—2 of the compressible feeding apparatus of FIG. 1 in the closed position.

Referring next to FIG. 2, the dispensing of liquids, semi-solid foodstuffs or other edible or medicinal materials from the compressible feeding apparatus 10 will now be described in greater detail. The compressible receptacle 12 is constructed of a thin, resilient material, for example, any desired plastic material such as polyvinylchloride, polyethylene or the like. The compressible receptacle 12 is comprised of the bottom wall 20 integrally formed with a plurality of annular bellows 22, each of a generally U-shaped cross-section and integrally joined to adjacent bellows by one of a first series of circumferential ribs 24 positioned between adjacent bellows 22. A second series of circumferential ribs 25 are provided at the midpoint of each bellows 22. In such a manner, a generally U-shaped, accordion-like bellows is provided. The top section 13 of the bellows 22, which as previously described provides a position for holding the compressible feeding apparatus 10, further includes an integrally formed cylindrical neck 26 of reduced diameter. Preferably the neck 26 should be provided with exterior threads 28 integrally molded therewith. In such a manner, the neck 26 defines the open end 11 of the compressible receptacle 12 by which the interior of the receptacle 12 may be accessed. When the receptacle 12 is compressed, the generally U-shaped bellows 22 compress at each of said first series of circumferential ribs 24 and at each of said second series of circumferential ribs 25, thereby reducing the volume of the compressible receptacle 12. Thus, a portion of the materials stored within the compressible receptacle 12 would be forced through the open end 11.

The nozzle assembly 14 is constructed to include a lid section 30 integrally formed with a nozzle section 42. The lid section 30 is comprised of the top section 32 which, as previously set forth, may be used to grasp the compressible feeding apparatus 10 during use, integrally formed with a downwardly extending circumferential lid sidewall 34. The lid sidewall 34 is sized to fit closely onto the neck 26 of the compressible receptacle 12 to cover the open end 11 of the compressible receptacle 12. A ridge 36 is provided on the inner side of the lid sidewall 34 to engage the exterior thread 28 of the neck 26, in a screw fit. By twisting the lid section 32 in a counter-clockwise direction, the lid section 32 may be screwed off the neck 26 to access the open end 11, thereby permitting a user of the compressible feeding apparatus to fill the compressible receptacle 12 with a material which the user desires to dispense, empty the compressible receptacle 12 of any material which may be stored therein, or to wash the interior of the compressible receptacle. Afterwards, the lid section 32 may be placed onto the neck 26 and twisted in a clockwise direction to screw the lid section 32 back onto the compressible receptacle 12.

The nozzle section 42 includes a first cylindrical section 43 which extends away from the lid section 32 at a generally orthogonal angle, a circumferential raised section 45 integrally formed with the first cylindrical section 43 and generally parallel with the lid section 32 and a second, cylindrical section 46 which extends away from the circumferential raised section 45. The second cylindrical section 46 terminates in a frusto-conical section 48. An interior channel 44 extends longitudinally along the entire length of the nozzle assembly 14 to permit the passage of materials propelled by the compression of the receptacle 12 therethrough. Material propelled through the interior channel 44 of the nozzle assembly 14 exit the nozzle assembly 14 through apertures 52 provided in the frusto-conical section 48 of nozzle portion 42. Preferably, a pair of apertures 52 positioned 180 degrees apart on the frusto-conical section 48 should be provided. It is fully contemplated, however, that the number and spacing of the apertures 52 may be varied. Finally, the frusto-conical section 48 terminates in a tip section 50 integrally formed therewith.

The utensil assembly 16 includes the utensil section 18, which is used to feed or otherwise administer material dispensed from the receptacle 12, integrally formed with a lower section 40 which is provided for slideable engagement between the utensil assembly 16 and the generally cylindrical section 42 of the nozzle assembly 14. The utensil assembly 16 is provided with a interior passage 56 defined by interior sidewalls 58. The interior passage 56 extends from the opening in the utensil section 18 through the interior of the utensil assembly 16, thereby providing for the delivery of dispensed material exiting the nozzle portion 42 to be delivered to the utensil portion 18. The interior passage 56 includes a narrower section 60 which, at its lower end 61, is sized to be of a circumference similar to the circumference of the tip 50. The narrower section 60 then expands into a frusto-conically shaped section 62 of dimensions similar to the frusto-conical section 48 and then continues in a second, wider section 64 sized slightly greater that the diameter of the cylindrical section 46 of the nozzle portion 42. The utensil assembly 16 further includes a widened section 53 for ready grasping of the utensil assembly 16 when movement of the slideably mounted utensil assembly 16 is desired.

Figure 3:
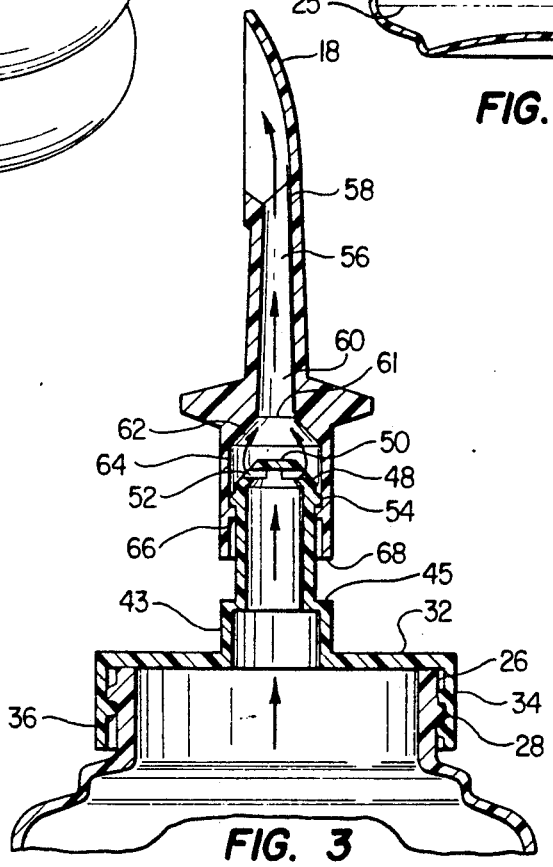
FIG. 3 is an enlarged partial cross-sectional view of the compressible feeding apparatus of FIGS. 1 and 2 in the open position.

The lower section 40 of the utensil assembly 16 operates in conjunction with the nozzle portion 42 of the nozzle assembly 14 to form a valve assembly for the compressible feeding apparatus 10. Specifically, an open/close valve is formed by the mating of the frusto-conical section 48 of the nozzle portion 42 and the interior sidewalls 58 of the utensil assembly 16. The lower portion 40 of the utensil assembly 16, which is slideably mounted on the nozzle assembly 14, may be alternately positioned in a first, or closed position as illustrated in FIG. 2, or in a second, or open position as illustrated in FIG. 3. In the closed position of FIG. 2, the inner sidewalls 58 which define the frusto-conical section 62 of the interior passage 56 mate with the outer surface of the frusto-conical section 48 of the nozzle portion 42, thereby blocking the apertures 52 from communication with the interior passage 56. The tip 50 of the frusto-conical section 48 engages with the section of the inner sidewalls 58 which define the lower end 61 of the interior passage 56, thereby blocking the lower end 61 of the interior passage 56. In such a manner, the passage of material from the receptacle 12 to the utensil 18 is blocked.

In the open position illustrated in FIG. 3, the lower portion 40 of the utensil assembly 16 has been moved to a second engagement position on the nozzle assembly. In this position, the outer surface of the frusto-conical section 48 no longer engages the inner sidewalls 58, thereby permitting the apertures 52 to be in open communication with the interior passage 56 of the utensil assembly 16. Furthermore, the tip 50 of the frusto-conical section 48 no longer blocks the lower end 61 of the interior passage 56. Thus, food being forced into the nozzle assembly 16 by compression of the receptacle 12 would travel through the interior channel 44 of the nozzle assembly 16, exit the interior channel 44 through the apertures 52, pass through the interior passage 56 and exit at the opening 19 where the dispensed material may collect prior to feeding or administering the dispensed material.

As previously set forth, the lower section 40 of the utensil assembly 16 operates in conjunction with the nozzle portion 42 of the nozzle assembly 14 to form a valve assembly for the compressible feeding apparatus 10 and, by such operation, the compressible feeding apparatus 10 may be alternately set into the closed position illustrated in FIG. 2 or the open position illustrated in FIG. 3. To move the compressible feeding apparatus 10 into the closed position, the utensil assembly 16 should be pushed downward until an end section 68 of the lower portion 40 of the utensil assembly 16 engages the circumferential raised section 45 of the nozzle assembly 42, thereby stopping the downward travel of the utensil assembly 16. When the end section 68 and circumferential raised section 45 are mated, the inner sidewalls 58 will block the apertures 52 from communication with the interior passage 56 and the tip 50 will block the lower end 61 of the interior passage 56, thereby preventing the passage of material from the receptacle 12 to the utensil 18 and closing the compressible feeding apparatus 10. To open the compressible feeding apparatus 10, the lower portion 40 of the utensil assembly 16 should be pulled upward until a circumferential protuberance 54 on the second cylindrical section 46 and an inner protuberance 66 formed on the inner sidewall 58 engage, thereby stopping the upward travel of the utensil assembly 16. In this, the open position, the apertures 52 are in open communication with the interior passage 56 of the utensil assembly 16, thereby permitting the flow of dispensed material from the interior channel 44 to the interior passage 56 when the receptacle 12 is compressed.

Figure 4:
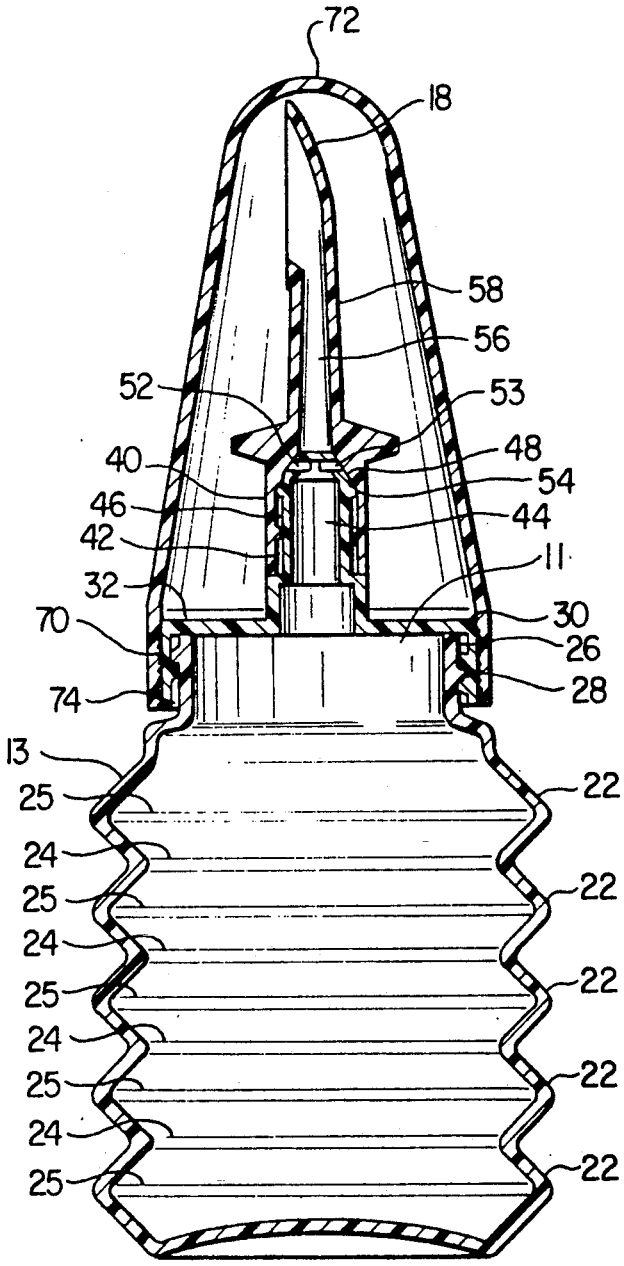
FIG. 4 is a cross-sectional view of a second embodiment of the compressible feeding apparatus of the present invention.

Referring next to FIG. 4, a cross-sectional view of a second, preferred, embodiment of the compressible feeder apparatus 10 subject of the present invention may now be seen. In accordance with this embodiment of the invention, the bellows 22 are formed as a plurality of generally V-shaped bellows 22 which are integrally joined to adjacent bellows 22 by one of a first series of circumferential ribs 24 positioned between adjacent bellows 22. A second series of circumferential ribs 25 are provided at the midpoint of each bellows 22. In such a manner, a generally V-shaped, accordion-like bellows is provided. When the receptacle 12 is compressed, the generally V-shaped bellows 22 compress at each of said first series of circumferential ribs 24 and at each of said second series of circumferential ribs 25, thereby reducing the volume of the compressible receptacle 12. Further in accordance with this embodiment of the invention, the lid section 30 now includes an externally threaded sidewall 70. A cap 72, which may be of any shape but which, in the embodiment disclosed herein, is illustrated in a rounded, generally frusto-conical shape, and which an internally threaded sidewall 74, is mounted onto the lid section 30 of the nozzle assembly 14 when the compressible feeder apparatus 10 is in the closed position.

Thus, there has been described and illustrated herein, a compressible feeding apparatus in which the utensil assembly is displaceable between first and second positions, thereby providing, in combination with the nozzle assembly, a closeable valve for the feeder apparatus. However, those skilled in the art will recognize that many modifications and variations besides those specifically mentioned may be made in the techniques described herein without departing substantially from the concept of the present invention. Accordingly, it should be clearly understood that the form of the invention described herein is exemplary only and is not intended as a limitation on the scope of the invention.

What is claimed is:

1. A compressible feeding apparatus comprising:

an axially compressible receptacle having an interior opening for storing liquid, semi-solid foodstuffs or other edible or medicinal materials therein, said receptacle having an open end in communication with said interior opening, a projecting neck section at said open end and a bottom section;

a nozzle assembly removably mounted on said receptacle to cover said open end, said nozzle assembly having a nozzle section having an exterior surface, an interior channel in communication with said open end and said exterior surface for passage of said materials therethrough and a lid section for mating with said receptacle, said lid section comprised of a raised section which circumferentially surrounds said nozzle section, a generally flat section for grasping said compressible feeding apparatus during axial compression of said receptacle, said axial compression actuated by pressure exerted on said bottom section, and a circumferential sidewall integrally formed with the outer periphery of said flat section, said circumferential sidewall mating with said projecting neck section of said compressible receptacle; and a utensil assembly having an exterior surface, said utensil assembly mounted on said nozzle assembly and displaceable between first and second positions, said utensil assembly having an interior passage defined by an interior sidewall for the delivery of said material therefrom, said utensil assembly having a widened section circumferentially extending around said exterior surface of said utensil assembly, said widened section providing for ready grasping when movement of said utensil assembly between said first and second positions is desired and a circumferential end wall;

wherein, in said first position, said interior channel and interior passage are in communication with each other and, in said second position, said interior channel is blocked from communication with said interior passage by the mating of said interior sidewall of said utensil assembly and said exterior surface of said nozzle assembly, said utensil assembly end wall and said raised section of said lid section circumferentially engaging along their widths when said apparatus is in said second position.

2. A compressible feeding apparatus as set forth in claim 1 wherein said interior passage includes a first, narrower section from which said material is delivered, and a second, wider section which slideably mates with said nozzle assembly.

3. A compressible feeding apparatus as set forth in claim 2 wherein said nozzle assembly further comprises a conically shaped nozzle end which terminates in a generally flat tip, said nozzle end having annular apertures along the conical sides thereof, said annular apertures in communication with said interior channel.

4. A compressible feeding apparatus as set forth in claim 3 wherein said wider section of said interior sidewall of said utensil assembly is conically shaped to complement said conically shaped nozzle end, said complementary interior sidewall mating with said conically shaped nozzle end when said utensil assembly is in said second position.

5. A compressible feeding apparatus as set forth in claim 4 wherein said generally flat tip of said nozzle assembly is received in said interior passage when said utensil assembly is in said second position, said nozzle assembly tip, thereby blocking interior passage.

6. A compressible feeding apparatus as set forth in claim 5 wherein said compressible receptacle further comprises a plurality of axially protruding bellows with circumferential ribs positioned therebetween, said bellows being compressible at said circumferential ribs.

7. A compressible feeding apparatus as set forth in claim 6 wherein said bottom section inwardly protrudes to provide improved grasping of said receptacle during axial compression.

8. A compressible feeding apparatus according to claim 1 wherein said projecting neck section further comprises a threaded protrusion and wherein the interior of said lid sidewall further comprises a protrusion for threaded engagement with said projecting neck section.

9. A compressible feeding apparatus according to claim 1 wherein said nozzle assembly further comprises a circumferential rib for limiting the travel of said slideably mounted utensil assembly and wherein said interior sidewall of said utensil assembly further comprises an inner circumferential rib for engaging said circumferential rib of said nozzle assembly to limit the travel of said slideably mounted utensil assembly, the ribs of said nozzle and utensil assemblies engaging when said compressible feeding apparatus is in said first position.

10. A compressible feeding apparatus according to claim 9 and further comprising a cap threadably mountable on said sidewall of said lid section of said nozzle assembly when said apparatus is in said second position, thereby covering said nozzle and utensil assemblies and preventing movement of said utensil assembly between said first and second positions.

* * * * *